US008051893B2

(12) United States Patent
Wobker et al.

(10) Patent No.: US 8,051,893 B2
(45) Date of Patent: Nov. 8, 2011

(54) LIQUID-COOLED PERMANENT CHILL MOLD FOR THE CONTINUOUS CASTING OF METALS

(75) Inventors: Hans-Günter Wobker, Bramsche (DE); Gerhard Hugenschütt, Belm (DE); Thomas Rolf, Osnabrück (DE)

(73) Assignee: KME Germany AG & Co. KG, Osnabrueck (DE)

( * ) Notice: Subject to any disclaimer, the term of this patent is extended or adjusted under 35 U.S.C. 154(b) by 431 days.

(21) Appl. No.: 12/262,520

(22) Filed: Oct. 31, 2008

(65) Prior Publication Data

US 2009/0139684 A1 Jun. 4, 2009

(30) Foreign Application Priority Data

Nov. 1, 2007 (DE) ..... 20 2007 015 266 U
Jan. 31, 2008 (DE) ..... 10 2008 007 082

(51) Int. Cl.
*B22D 11/124* (2006.01)

(52) U.S. Cl. ..... 164/443; 164/348; 164/418; 164/459; 164/485

(58) Field of Classification Search ..... 164/348, 164/418, 443, 459, 485
See application file for complete search history.

(56) References Cited

U.S. PATENT DOCUMENTS

| | | | | |
|---|---|---|---|---|
| 3,583,469 | A * | 6/1971 | Peytavin et al. | 164/464 |
| 5,513,691 | A * | 5/1996 | Langner et al. | 164/418 |
| 6,419,004 | B1 * | 7/2002 | Jolivet et al. | 164/418 |
| 6,443,218 | B1 * | 9/2002 | Hornschemeyer | 164/418 |
| 2005/0028960 | A1 * | 2/2005 | Hauri et al. | 164/418 |
| 2006/0237161 | A1 * | 10/2006 | Roehrig et al. | 164/443 |

* cited by examiner

*Primary Examiner* — Jessica L Ward
*Assistant Examiner* — Kevin E Yoon
(74) *Attorney, Agent, or Firm* — Kenyon & Kenyon LLP

(57) ABSTRACT

A liquid-cooled permanent chill mold for the continuous casting of metals, including a permanent chill mold plate (2) made of copper or a copper alloy and an adapter plate (3), on which the permanent chill mold plates (2) are fastened via fastening bolts (12). The permanent chill mold plates (3) are coupled to the adapter plates (3) via sheet metal holders (19) situated in their top regions and base regions (20, 21), in addition to via the fastening bolts (12).

18 Claims, 5 Drawing Sheets

LIQUID-COOLED PERMANENT CHILL MOLD FOR THE CONTINUOUS CASTING OF METALS

BACKGROUND OF THE INVENTION

1. Field of the Invention

The present invention relates to a liquid-cooled permanent chill mold for the continuous casting of metals.

2. Description of Related Art

It is within the related art to rough-work permanent chill mold plates from massive copper blocks, especially if the permanent chill mold plate is to be a component of a broad face plate in a beam blank mold. A beam blank mold is used for producing a preliminary I-profile by casting technique, which after casting is to be processed further by rolling technology. The casting surface geometry and also the cooling channel geometry are produced by cutting operations on the copper blocks. The permanent chill mold plates have very thick walls. Based on this construction principle and production principle, the possibilities are limited for shaping the cooling gap geometry according to requirements. Furthermore, thermal expansions of the regions close to the casting surfaces, which are created as a result of heat inputs by the metal melt, are impeded based on the thick-walled, and therefore stiff execution of the permanent chill mold plate, which increases the operating stress in the regions close to the casting surfaces.

In view of the fact that the copper permanent chill mold plate has been developed to be thick-walled up to now, as a rule, the fastening bolts for connecting the permanent chill mold plate to the adapter plate being typically selected to be greater than M 16, there has been no problem with maintaining greater distances between the fastening bolts. During the course of the transition to thin-walled permanent chill mold plates, because of the limited depth of screwing in the fastening bolts, one is only able to work now with fastening bolts that are smaller than, or equal to M 16. As a result of the stresses on the permanent chill mold plate during continuous casting, in the form of thermal expansions, cooling water pressure, clamping forces, the strain between the permanent chill mold plate and the adapter plate, as well as the limited space for fastening the permanent chill mold plate on the adapter plate, there is created, particularly in the top and base regions of the broad face plate, the problem of assuring a mold-strength fixing of the thin-walled permanent chill mold plate.

The conventional strain of the permanent chill mold plate and the adapter plate using fastening bolts is also disruptive based on the necessary sealing of the permanent chill mold plate from the adapter plate, since a seal has to be put around the fastening bolts. Besides that, fastening bolts situated in the edge region lead to additional uncooled, or rather poorly cooled regions of the permanent chill mold plate. Finally, in the case of a beam blank mold, an additional difficulty is the special geometry of a broad face plate in the area of the rounded transitions between the legs and the middle cross-piece on the one hand, and the legs and the flanges at the edge on the other hand. At this point, high pressure forces have to be transferred without, however, having enough space for a sufficient number of fastening bolts.

BRIEF SUMMARY OF THE INVENTION

Accordingly, it is an object of the invention to create a permanent chill mold, particularly a beam blank mold for the continuous casting of metals, in which a thin-walled permanent chill mold plate, especially in its problematical top and base regions, is able to be connected flawlessly to an adapter plate.

This and other objects of the invention are attained by a liquid-cooled permanent chill mold for the continuous casting of metals, comprising a permanent chill mold plate (2) made of copper or a copper alloy and adapter plates (3), on which the permanent chill mold plates (2) are fastened via fastening bolts (12), wherein the permanent chill mold plates (3) are coupled to the adapter plates (3) via sheet metal holders (19) situated in their top regions and their base regions (20, 21), in addition to being coupled via the fastening bolts (12).

BRIEF DESCRIPTION OF THE DRAWINGS

The present invention will be described in greater detail with reference to the following drawings wherein.

DETAILED DESCRIPTION OF THE INVENTION

Figure 1:
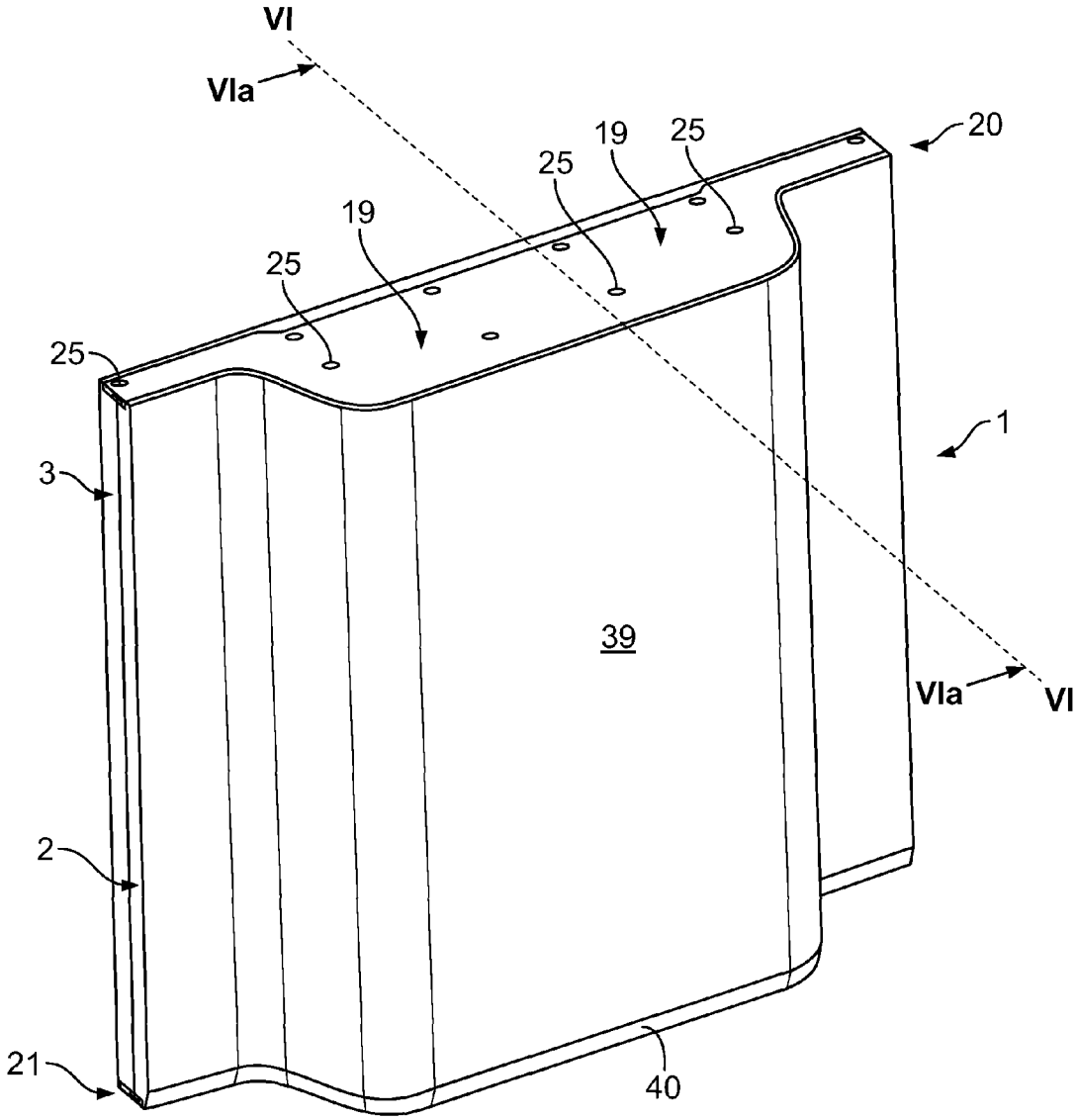
FIG. 1 shows a broad face plate of a beam blank mold in perspective, as seen from the casting side.

According to the present invention, the permanent chill mold plate and the adapter plate are coupled to each other, in their top and base regions, specifically using sheet metal holders. The connection of the permanent chill mold plate to the adapter plate consequently takes place, on the one hand, based on a combination of fastening bolts known per se, and sheet-metal holders of a new type in the top and base regions of permanent chill mold plate and adapter plate, on the other hand. In this instance, the sheet metal holders are connected to the adapter plate in a fixed manner. The coupling of the sheet metal holders to the permanent chill mold plate, by contrast, is designed so that the sheet metal holders do not permit any movement of the permanent chill mold plate in the direction towards the mold cavity of the permanent chill mold. However, the permanent chill mold plate is able to expand in the transverse direction and the vertical direction so as to minimize the material stresses that are caused by the thermal stresses of the permanent chill mold plate during continuous casting. Within the scope of the invention, it is particularly advantageous that, because of the sheet metal holders, a whole-surface optimal cooling of the permanent chill mold plate is assured right into the direct top and base regions.

The permanent chill mold is especially a beam blank mold, the permanent chill mold plate being preferably a component of a broad face plate. The permanent chill mold may also be a slab mold or a thin slab mold.

The coupling of the permanent chill mold plate to the adapter plate via sheet metal holders, in the top regions and the base regions, also makes it possible to conduct straight running seals past in the immediate vicinity of the sheet metal holders, without their course being disturbed by fastening bolts that usually are situated there. The seals are preferably embedded in grooves in the adapter plate, and lie against the back side of the permanent chill mold plate.

The fastening bolts preferably engage with insular plateau pedestals, that protrude on the back side of the permanent chill mold plate, which extend at least partially into the cooling gap between the permanent chill mold plate and the adapter plate, and which have a streamlined shape adjusted to the flow direction of the cooling medium.

The production costs of the broad face plate according to the present invention are clearly more favorable than in usual manufacturing. In addition, copper materials of greater strength, such as CuAg, CuCrZr, CuCoBe or CuNiBe may be used. The permanent chill mold plate may be produced both from the solid material and from preformed sheet metal.

The sheet metal holders preferably engage with particularly large surface projections in the top end and base end recesses of the adapter plate. In addition, at that location they may be screw fitted to the adapter plate and may also be coupled at the edge with the permanent chill mold plate via slot and feather constructions. In this connection, it is advantageous that both in the top region and the base regions two sheet metal holders each are provided. This not only simplifies assembly, but also the disassembly of the sheet metal holders when there are great stresses generated in the permanent chill mold plate during operation.

In view of the fact that the sheet metal holders engage with projections in the top end and base end recesses in the adapter plate, they have a secure hold, and for this reason they develop a flawless backing up for the thermally conditioned fixing of the permanent chill mold plate, that is movable in a limited way.

In this connection it is particularly advantageous if the permanent chill mold plate has longitudinal grooves in the top region and the base region, in which the sheet metal holders engage using feathers at their edge.

The longitudinal grooves are preferably bordered, on the one side, by edge beads of the permanent chill mold plate, and on the other side, by crosspieces developed on their back side. This embodiment particularly advantageously meets the development of a thin walled permanent chill mold plate.

It is also expedient if the crosspieces in the region of the lateral end faces of the permanent chill mold plate run out in an oblique manner to its back side.

According to one further refinement, the feathers on the sheet metal holders are developed based on inner recesses of the sheet metal holders, which engage over the crosspieces at the permanent chill mold plate and slats next to the crosspieces on the adapter plate, and thereby contribute to the flawless coupling of the permanent chill mold plate and the adapter plate.

In order to accommodate forces that act on the permanent chill mold plate in two directions, at the rounded transitions from the legs to the flanges at the extremities of the permanent chill mold plate, and in order, at the same time, to be able to permit motion in the vertical and the transverse direction without negatively influencing heat dissipation in these areas, it is provided that sliding slats be provided on the back side of the permanent chill mold plate, along the convexly rounded transitions from the legs that join the middle crosspiece to the flange at the edge end, that run vertically, that is, in the casting direction, while, analogously to the sliding slats of the permanent chill mold plate, on the cooling side of the adapter plate, in the area of the grooves between the flanges at the edge and the oblique legs, holding slats are situated vertically, that is, also in the casting direction. These sliding slats and holding slats permit a directed displacement of the permanent chill mold plate, the sliding slats supporting the permanent chill mold plate in such a way, in the region of the contact surfaces to the transverse plates of the broad face plate, that no deformation of the permanent chill mold plate is able to be created by the clamping forces in these regions.

Furthermore, it is of advantage if the sliding slats are components of the permanent chill mold plate, all as one piece.

The sheet metal holders are expediently detachably anchored in position in grooves on the cooling side of the adapter plate.

According to one advantageous refinement, the sheet metal holders provided in the base region may be provided with bevels at the end faces of the feathers.

The bevel provided in the base region of the permanent chill mold plate, on the casting side, prevents the steel billet from bedding squarely against the permanent chill mold plate. In this way the heat transfer is reduced and with this it is prevented that the seal between the permanent chill mold plate and the adapter plate is damaged, based on the high heating of the permanent chill mold plate.

Referring to the drawings, a broad face plate, designated by 1, is shown in FIG. 1 for a liquid-cooled beam blank mold, that is not shown in detail, for the continuous casting of metals. Two such broad face plates 1 together with narrow side plates, that are also not shown in greater detail, form the mold cavity of the beam blank mold.

Figure 6:
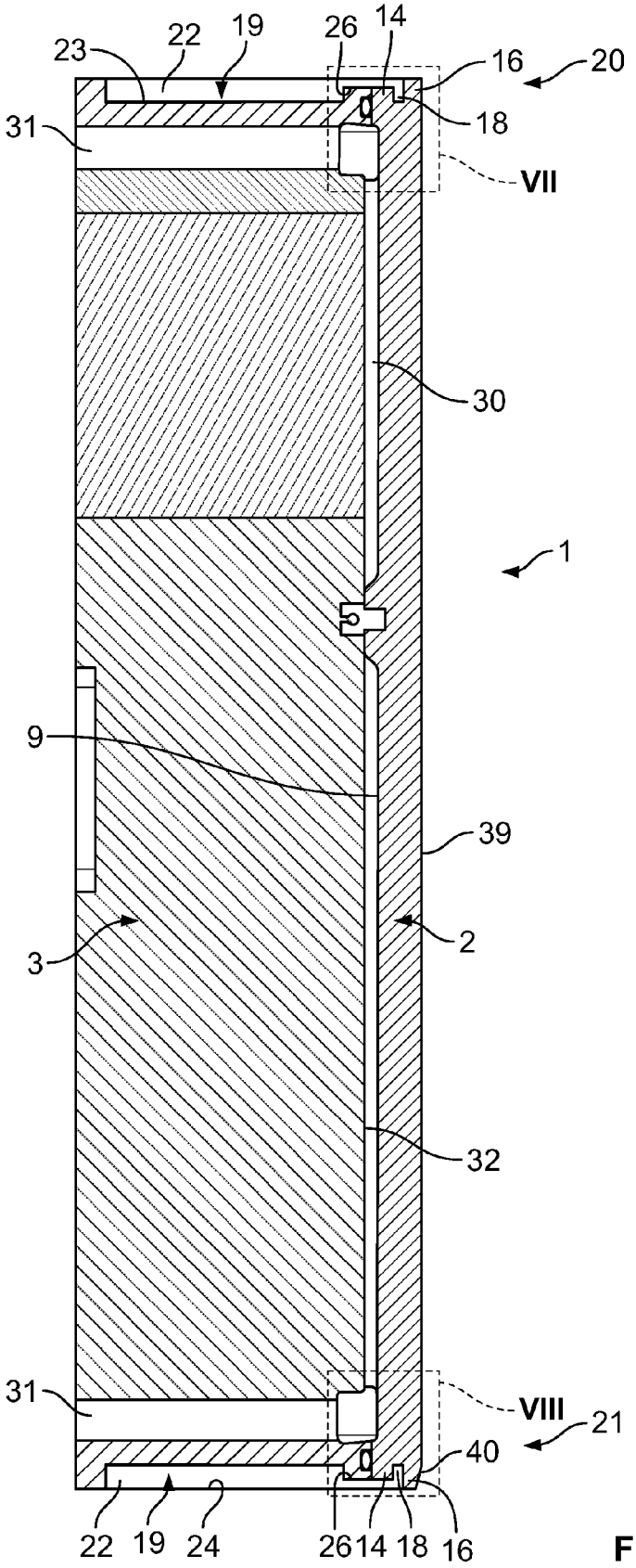
FIG. 6 shows a vertical cross section through the illustration in FIG. 1, along the line VI-VI, as seen in the direction of arrows VIa.
Figure 7:
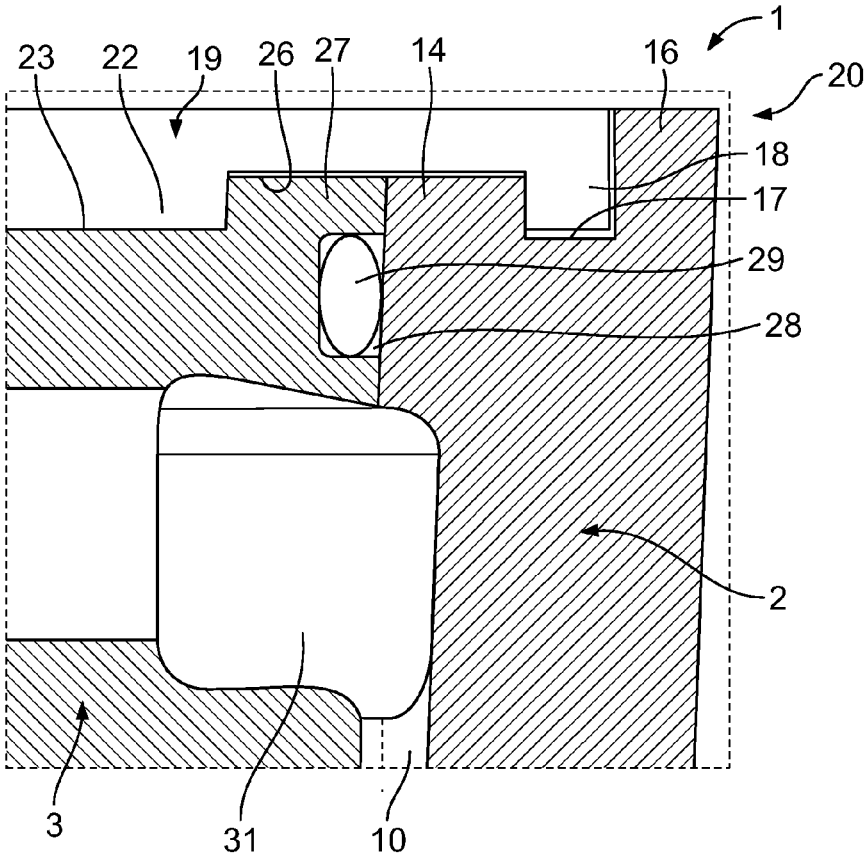
FIG. 7 shows the cutout VII in FIG. 6, in an enlarged illustration.
Figure 8:
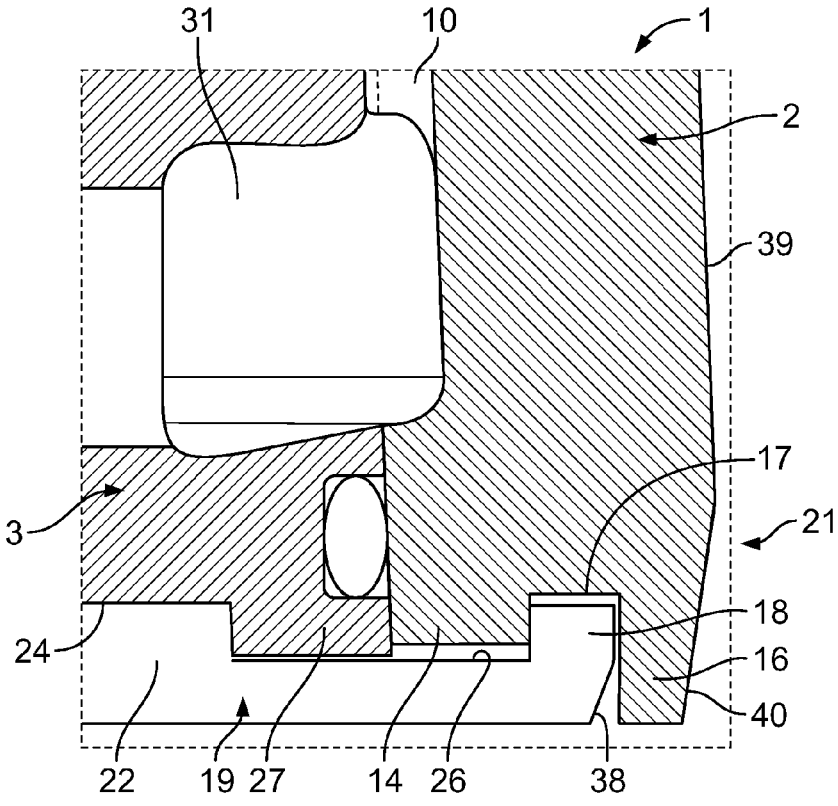
FIG. 8 shows the cutout VIII in FIG. 6, in an enlarged illustration.

Broad face plate 1 is composed of a thin-walled permanent chill mold plate 2 and an adapter plate 3 that carries the permanent chill mold plate 2 and is thick-walled compared to the former (see also FIGS. 6 to 8).

Figure 2:
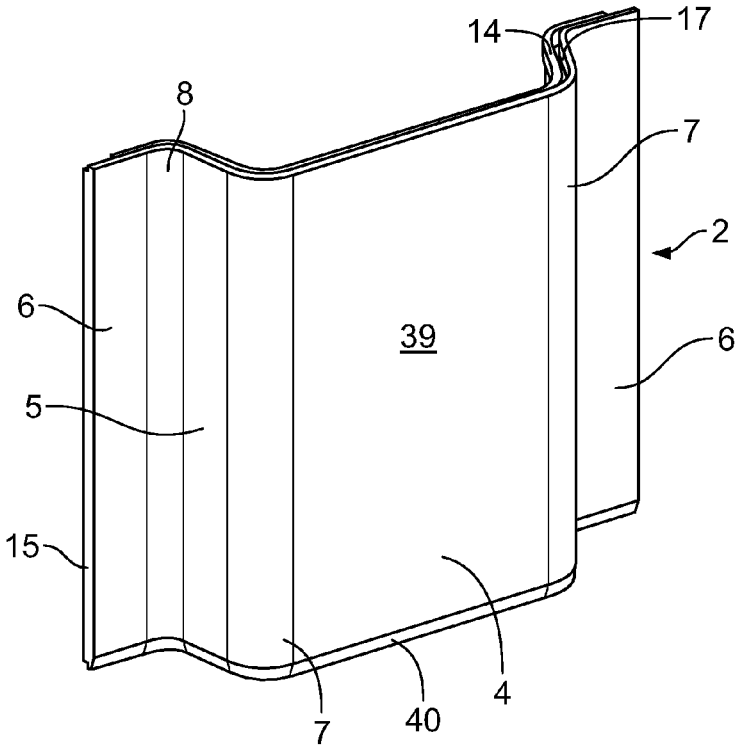
FIG. 2 shows a permanent chill mold plate of the broad face plate, also seen in perspective and from the casting side.
Figure 3:
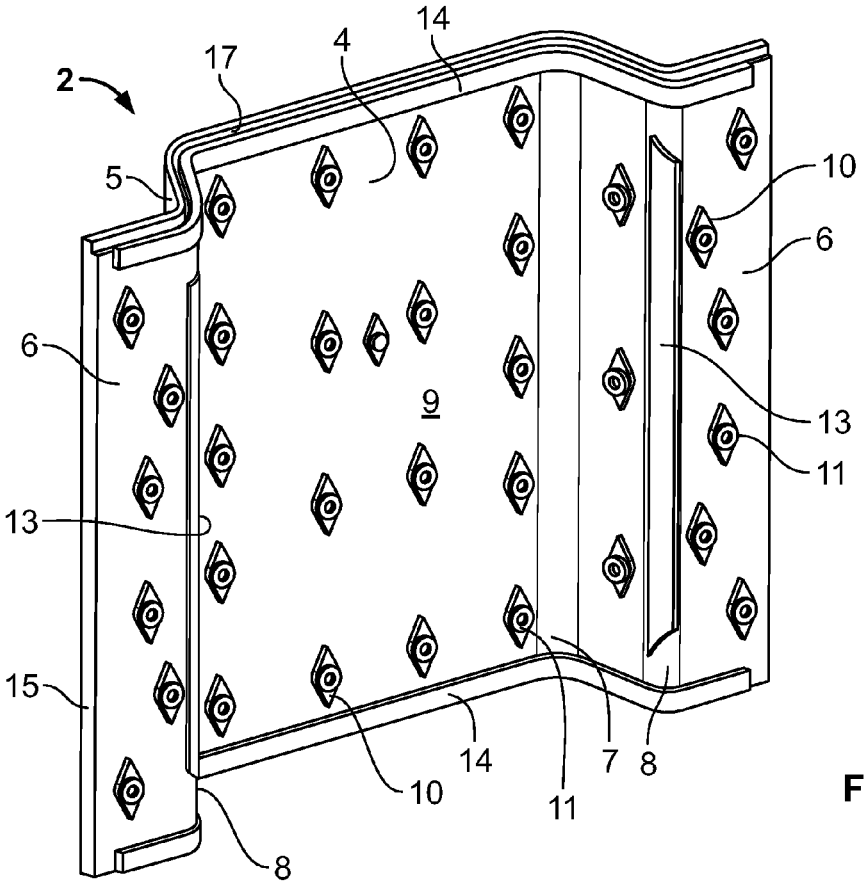
FIG. 3 shows the back side of the permanent chill mold plate of FIG. 2, in perspective.

As may be seen from FIGS. 2 and 3, permanent chill mold plate 2 includes a middle crosspiece 4, oblique legs 5 adjoining crosspieces 4, as well as flanges 6 at the extremities. Transitions 7, 8 from crosspiece 4 to legs 5 and from legs 5 to flange 6 are rounded.

Figure 4:
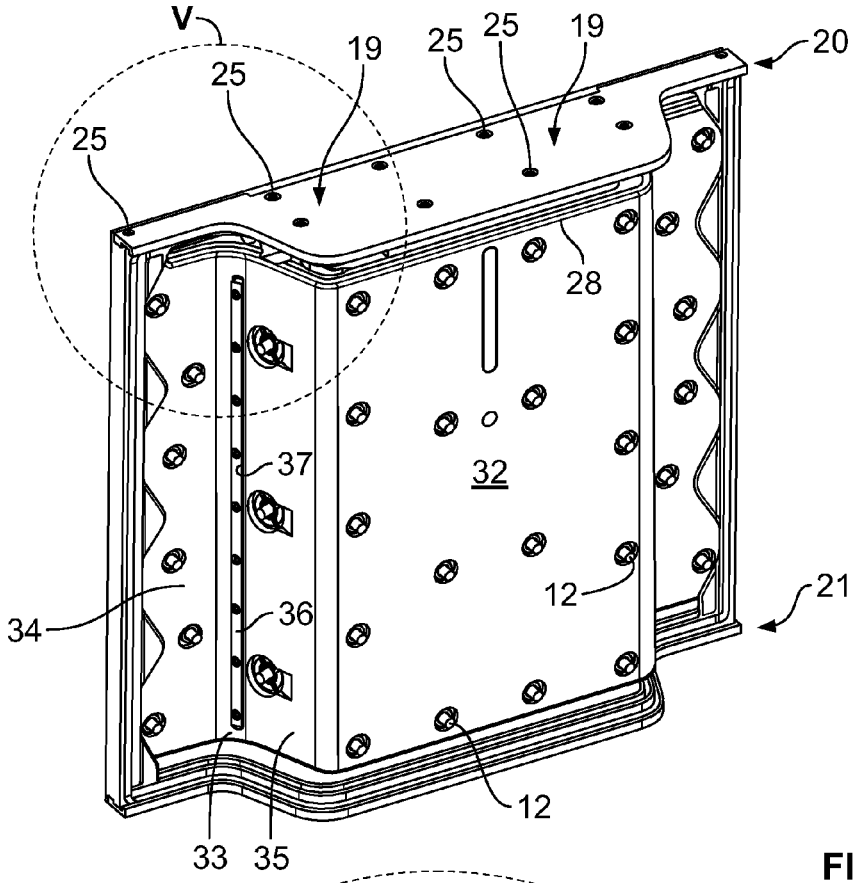
FIG. 4 shows the broad face plate of FIG. 1 with the permanent chill mold plate removed, in perspective.
Figure 5:
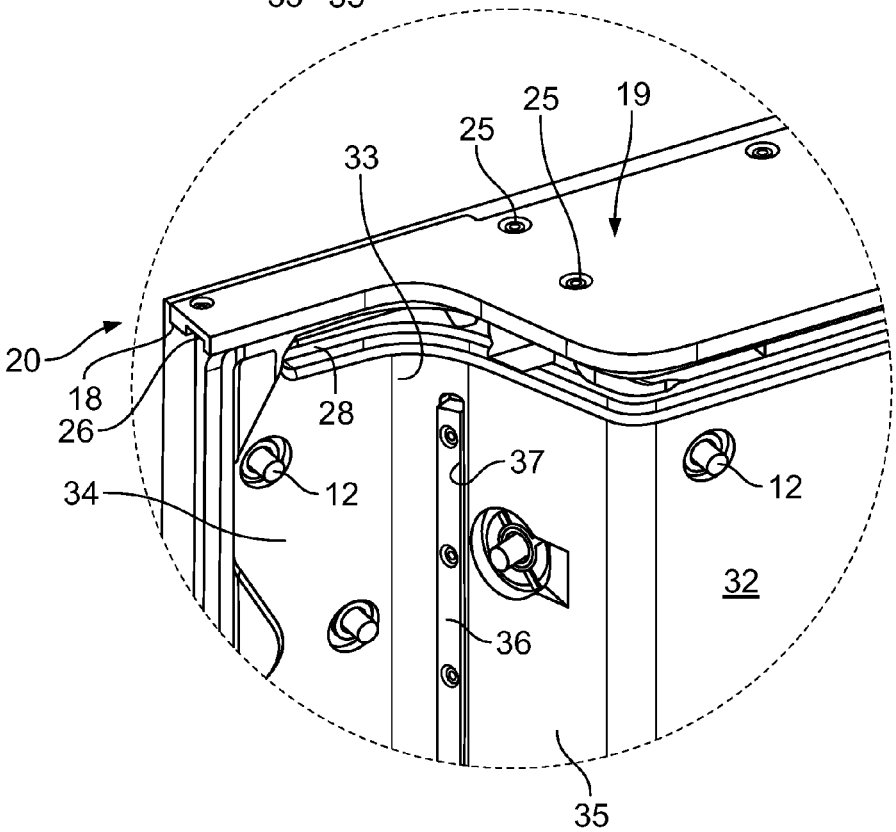
FIG. 5 shows the cutout V in FIG. 4, in an enlarged illustration.

On the back side 9 of permanent chill mold plate 2 there are rhombic plateau pedestals 10, which are used for fixing threaded sleeves 11, into which fastening bolts 12, which may be seen in FIGS. 4 and 5, may be screwed for connecting permanent chill mold plate 2 to adapter plate 3.

It may also be seen in FIG. 3 that on back side 9 of permanent chill mold plate 2, along the convexly rounded transitions 8, sliding slats 13 are provided which run vertically from legs 5 to flange 6. Sliding slats 13 form an all-in-one-piece component of permanent chill mold plate 2. However, in this case they extend over about 80% of the height of permanent chill mold plate 2.

At the upper and lower edges of permanent chill mold plate 2, crosspieces 14, that run transversely to the casting direction, extend on back side 9 which run out slantwise in the region of lateral end faces 15 of permanent chill mold plate 2 towards its back side 9. As may be recognized by an overall viewing of FIGS. 3 and 6 to 8, crosspieces 14 together with edge beads 16 of permanent chill mold plate 2 border on longitudinal grooves 17. Feathers 18 engage into longitudinal grooves 17, and the former are situated at the edges of sheet metal holders 19 that may be seen from FIGS. 1 and 4 to 8. Sheet metal holders 19 are adapted to the configuration of broad face plate 1. In each case, two sheet metal holders 19 are provided in the top and base regions 20, 21 of broad face plate 1, which impinge on one another in the vertical center transverse plane of broad face plate 1.

Sheet metal holders 19, using projections 22, engage in top and base end recesses 23, 24 of adapter plate 3, and are screw fitted to adapter plate 3, as may be seen in FIGS. 1, 4 and 5. In the exemplary embodiment, five screw fittings 25 are provided per sheet metal holder 19. Feathers 18 on sheet metal holders 19 are formed based on inner recesses 26 of sheet metal holders 19, which engage over crosspieces 14 on permanent chill mold plate 2 and over slats 27, on adapter plate 3, that are adjacent to crosspieces 14.

In the area of crosspieces 14 and slats 27, there are seals 29 that are inserted into grooves 28 of adapter plate 3. In addition, it may be seen in FIG. 6 that a cooling gap 30 is provided between permanent chill mold plate 2 and adapter plate 3, for guiding a cooling medium. Supplies 31 for the cooling medium may be seen in FIGS. 6 through 8.

Analogously to sliding slats 13 of permanent chill mold plate 2, holding slats 36 are situated on cooling side 32 of adapter plate 3 (FIGS. 4 and 5) in the area of grooves 33 between flanges 34 at the edge and oblique legs 35, and they extend vertically. Holding slats 36 are detachably secured in position in grooves 37 of cooling side 32 of adapter plate 3

FIGS. 1, 6 and 8 show that a bevel 40 is provided in base area 21 of permanent chill mold plate 2 on casting side 39.

On sheet metal holders 19 provided in base region 21, bevels 38 are also located on feathers 18.

What is claimed is:

1. A liquid-cooled permanent chill mold for the continuous casting of metals, comprising:

a permanent chill mold plate made of copper or a copper alloy; and an adapter plate, on which the permanent chill mold plate is fastened via fastening bolts, wherein the permanent chill mold plate is coupled to the adapter plate via sheet metal holders situated in their top regions and their base regions, in addition to being coupled via the fastening bolts, the sheet metal holders each having a projection that engages a U-shaped recess formed in the adapter plate.

2. The permanent chill mold according to claim 1, wherein the permanent chill mold plate is a component of slab molds or thin slab molds, or a component of a broad face plate of a beam blank mold.

3. The permanent chill mold according to claim 1, wherein the sheet metal holders engage in top end and base end recesses of the adapter plate by projections.

4. The permanent chill mold according to claim 2, wherein the sheet metal holders engage in top end and base end recesses of the adapter plate by the projections.

5. The permanent chill mold according to claim 1, wherein the sheet metal holders are coupled to the permanent chill mold plate via slot and feather constructions.

6. The permanent chill mold according to claim 2, wherein the sheet metal holders are coupled to the permanent chill mold plate via slot and feather constructions.

7. The permanent chill mold according to claim 3, wherein the sheet metal holders are coupled to the permanent chill mold plate via slot and feather constructions.

8. The permanent chill mold according to claim 3, wherein the permanent chill mold plate has longitudinal grooves in the top region and in the base region, in which the sheet metal holders engage by feathers at the edges.

9. The permanent chill mold according to claim 8, wherein the longitudinal grooves are bordered, on the one side, by edge beads of the permanent chill mold plate, and, on the other side, by crosspieces developed on their back side.

10. The permanent chill mold according to claim 9, wherein the crosspieces, in the region of the lateral end faces of the permanent chill mold plate, run out extend obliquely in a direction towards a back side of the chill mold.

11. The permanent chill mold according to claim 9, wherein the feathers on the sheet metal holders are formed based on inner recesses of the sheet metal holders, which engage over crosspieces on the permanent chill mold plate and over slats, on the adapter plate, that are adjacent to the crosspieces.

12. The permanent chill mold according to claim 10, wherein the feathers on the sheet metal holders are formed based on inner recesses of the sheet metal holders, which engage over crosspieces on the permanent chill mold plate and over slats, on the adapter plate, that are adjacent to the crosspieces.

13. The permanent chill mold according to claim 1, wherein the sheet metal holders provided in the base region are provided with bevels at the end faces of feathers.

14. The permanent chill mold according to claim 1, wherein a casting side of the permanent chill mold plate is provided with a bevel in the base region.

15. A liquid-cooled permanent chill mold for the continuous casting of metals, comprising:

a permanent chill mold plate made of copper or a copper alloy; and an adapter plate, on which the permanent chill mold plate is fastened via fastening bolts, wherein the permanent chill mold plate is coupled to the adapter plate via sheet metal holders situated in their top regions and their base regions, in addition to being coupled via the fastening bolts, wherein the permanent chill mold plate has a middle crosspiece, legs adjacent to middle crosspiece and a flange adjacent to legs at the edge, rounded transitions being located between the legs and the flanges; the permanent chill mold plate having sliding slats, on its back side in the vicinity of the transitions, that extend in the casting direction, while, analogous to the sliding slats of the permanent chill mold plate, at a cooling side of the adapter plate in the vicinity of grooves between the flanges at the edge and the oblique legs, holding slats are situated which also extend in the casting direction.

16. The permanent chill mold according to claim 15, wherein the sliding slats are components of the permanent chill mold plate, all in one piece.

17. The permanent chill mold according to claim 15, wherein the holding slats are detachably secured in position in the grooves of the cooling side of the adapter plate.

18. The permanent chill mold according to claim 16, wherein the holding slats are detachably secured in position in the grooves of the cooling side of the adapter plate.

* * * * *